US007325802B2

(12) United States Patent
Asakawa et al.

(10) Patent No.: US 7,325,802 B2
(45) Date of Patent: Feb. 5, 2008

(54) ALIGNING DEVICE AND IMAGE FORMING SYSTEM INCLUDING THE SAME

(75) Inventors: Masaya Asakawa, Yamatokoriyama (JP); Masahiko Fujita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 602 days.

(21) Appl. No.: 10/460,179

(22) Filed: Jun. 13, 2003

(65) Prior Publication Data

US 2003/0230846 A1 Dec. 18, 2003

(30) Foreign Application Priority Data

Jun. 13, 2002 (JP) ..... 2002-173117

(51) Int. Cl.
*B65H 5/06* (2006.01)

(52) U.S. Cl. ..... 271/273; 271/274; 271/240

(58) Field of Classification Search ..... 271/240, 271/246, 248, 272–274, 117–118, 18.2
See application file for complete search history.

(56) References Cited

U.S. PATENT DOCUMENTS 4,986,527 A * 1/1991 Ogoda ..... 271/250
5,030,025 A * 7/1991 Mitcham et al. ..... 400/636
5,516,093 A * 5/1996 Ballard et al. ..... 271/240
5,909,872 A * 6/1999 Takahashi ..... 271/116
6,022,015 A * 2/2000 Matsumoto ..... 271/121
6,082,731 A * 7/2000 Yamazaki ..... 271/240
6,209,861 B1 * 4/2001 Kakuta et al. ..... 271/3.02
6,293,537 B1 * 9/2001 Park ..... 271/10.13
6,446,960 B1 * 9/2002 Okada ..... 271/240
6,736,390 B2 * 5/2004 Chihara ..... 271/186
6,817,611 B2 * 11/2004 DiRamio ..... 271/273
7,090,215 B2 * 8/2006 Mandel et al. ..... 271/273
2003/0122913 A1 * 7/2003 Lee et al. ..... 347/104

FOREIGN PATENT DOCUMENTS

JP 1-40696 Y2 12/1989
JP 7-129018 A 5/1995

* cited by examiner

*Primary Examiner*—Patrick Mackey
*Assistant Examiner*—Jeremy Severson
(74) *Attorney, Agent, or Firm*—Birch, Stewart, Kolasch & Birch, LLP

(57) ABSTRACT

An aligning device in accordance with the present invention is arranged in such a manner that a feed section for feeding a sheet and a release section for releasing a pinching force exerted to the sheet by the feed section are driven by a single motor. With this arrangement, it is possible to obtain an aligning device for a sheet on which an image is formed, which is low-cost and has a simple structure.

9 Claims, 6 Drawing Sheets

ALIGNING DEVICE AND IMAGE FORMING SYSTEM INCLUDING THE SAME

FIELD OF THE INVENTION

The present invention relates to an aligning device for aligning a sheet in midstream of a sheet feeding path, and an image forming system including the aligning device, such as a photocopier, printer, and a facsimile machine.

BACKGROUND OF THE INVENTION

For the sake of resource saving and efficiency promotion, there has recently been an increase demand for image forming devices which can print images on both sides of a sheet, and image forming systems in which the image forming device is combined with peripheral devices so that image forming is efficiently carried out. Such a image forming system as above adopts switchback mechanism, etc. and hence a sheet on which an image has already been formed on one side is reversed and fed to the image forming device again, and an image is formed on the other side of the sheet. Further, the image forming system sends a sheet with finished images to post-treatment devices, in order to subject the sheet to a punch hole treatment for making a punch hole and a staple treatment for stapling.

On the occasion of image forming by which images are formed on both sides of a sheet (hereinafter, this image forming process will be referred to as duplex image forming) or on the occasion of carrying out the foregoing post-treatments, sheets which are successively fed are not stacked in proper alignment, since the sheets are fed over long distances. In particular, the misalignment tends to occur in the direction orthogonal to the direction of sheet feeding. For this reason, in the case of the duplex image forming, an image on one side is not properly aligned with an image on the other side so that the results of the image forming have insufficient quality. Further, the above-mentioned post-treatment results in production of a book in which sheets are not properly aligned, and hence it is not possible to provide high-quality books. Moreover, when sheets are fed over great distances, the misalignment could cause damage to the sheets.

To solve this problem, an operation of aligning a sheet (hereinafter, this operation will be referred to as alignment operation) is carried out before feeding the sheet to an image forming device again and before carrying out post-treatments in a post-treatment device, and may be carried out in midstream of a sheet feeding path when the path is particularly long. This alignment operation aims at eliminating misalignment in the direction orthogonal to the direction of sheet feeding. More specifically, after the sheet pinched by pairs of feed rollers for feeding sheets is released, the misalignment of the sheet is corrected by an aligning device including alignment means called jogger. Then the pairs of feed rollers pinch the sheet again, and post-treatments are carried out. In this arrangement, the release of the sheet pinched by the pairs of feed rollers is carried out using a solenoid.

However, the above-mentioned conventional aligning device has such a problem that the release of the sheet requires strong force.

This is because the pinching forces exerted by the pairs of feed rollers are set so as to be strong in order to surely feed the sheet without causing misalignment. Since a plurality of pairs of feed rollers are provided at intervals allowing to feed a minimum-sized sheet, it is necessary to release the pinching forces exerted by the plurality of pairs all at once, when aligning operation for a maximum-sized sheet is carried out. For instance, the aligning operation for an A3-sized sheet requires to release the forces exerted by 3-4 pairs of feed rollers all at once. Further, to avoid complicated machinery, conventional aligning devices release pinching forces of all pairs of feed rollers irrespective of the size of sheet. This is also the reason why the release of the pinching forces requires strong power.

Since the release of the pinching forces requires strong power, the use of a solenoid which exerts strong power is necessary, and this causes the increase of costs.

Moreover, the foregoing aligning device separately includes a drive unit for the pairs of feed rollers and the solenoid so that upsizing of the device is unavoidable.

SUMMARY OF THE INVENTION

The present invention is an attempt to solve the foregoing problems, and hence aims at providing an aligning device which is low-cost and has a simple structure, and an image forming device including this aligning device.

To solve these problems, the aligning device of the present invention is characterized by comprising: a feed section for feeding a sheet on which an image is formed; and a release section for releasing a pinching force exerted to the sheet by the feed section, a position of the sheet being aligned in a sheet-width direction orthogonal to a direction of sheet feeding, by releasing the pinching force by the release section, wherein, the feed section and the release section are driven by a single motor.

According to this arrangement, the sheet feeding by the feed section and the release of the pinching force exerted to the sheet by the feed section are carried out by the single motor.

When performing sheet alignment in the sheet-width direction orthogonal to the direction of sheet feeding, first, the pinching force exerted by the feed section is released by the release section, with respect to the sheet having been fed by the feed section. Then the sheet is aligned on condition that the pinching force is not exerted to the sheet. In this manner, two different operations, namely the sheet feeding and the release of the pinching force exerted to the sheet, are carried out.

Thus, since the feed section for feeding the sheet and the release section for releasing the pinching force exerted to the sheet are driven by the single motor, it is unnecessary to independently provide a motor for the feed section and a motor for the release section, and hence the device can be downsized and the manufacturing costs thereof can be reduced. Further, the sharing of the single motor allows to reduce the numbers of control signal lines and power supply lines for controlling the feed section and the release section. Also, the control is easily performed, since it is unnecessary to control a plurality of motors. For these reasons, the aligning device which is low-cost and has a simple structure can be obtained.

To solve the foregoing problems, the image forming system in accordance with the present invention is characterized by comprising the above-mentioned aligning device of the present invention.

According to this arrangement, the image forming system includes the aligning device in which the sheet feeding by the feed section and the release of the pinching force exerted to the sheet by the sheet feed section are carried out by the single motor.

Thus, it is unnecessary to independently provide a motor for the feed section and a motor for the release section, and hence the aligning device can be downsized and the manufacturing costs thereof can be reduced. For this reason, it is possible to downsize the image forming system itself, and reduce the cost for manufacturing the same.

For a fuller understanding of the nature and advantages of the invention, reference should be made to the ensuing detailed description taken in conjunction with the accompanying drawings.

DESCRIPTION OF THE EMBODIMENTS

The following will describe an embodiment of the present invention in reference to FIGS. 1-6.

Figure 2:
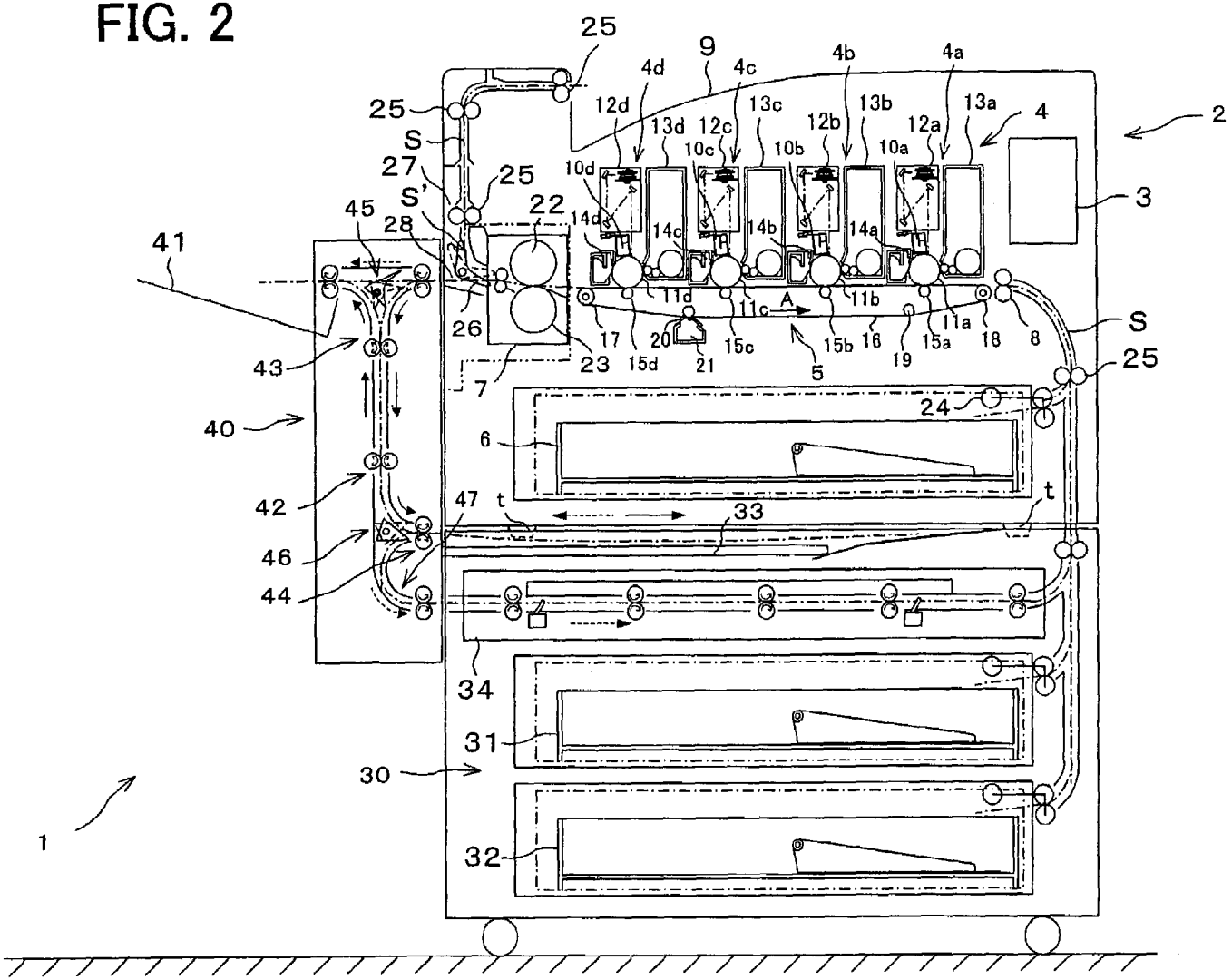
FIG. 2 is a schematic diagram of an image forming system including the aligning device.

FIG. 2 is a cross section illustrating an overall arrangement of an image forming system 1 in accordance with the present embodiment. An image forming device 2 forms (puts) a multicolor/monochrome image on a predetermined sheet, in compliance with image data transmitted from the outside. This image forming device 2 includes a control section 3, image forming sections 4*a*-4*d*, a transfer feed belt unit 5, a paper feed tray 6, a fixing unit 7, a registration roller 8, a feeder output tray 9, and a sheet feeding path S.

The image forming sections 4*a*-4*d* form respective color images of black (K), cyan (C), magenta (M), and yellow (Y). The respective image forming sections 4*a*-4*d* include charging units 10*a*-10*d*, photosensitive drums 11*a*-11*d*, photolithography units 12*a*-12*d*, developing units 13*a*-13*d*, and cleaner units 14*a*-14*d*.

The charging units 10*a*-10*d* are charging means for charging the surfaces of the respective photosensitive drums 11*a*-11*d* so as to supply a predetermined voltage thereto. Although these charging units 10*a*-10*d* are charge-type as illustrated in FIG. 2, it is possible to adopt roller-type or brush-type charging units which are impact type. As in FIG. 2, the photolithography units 12*a*-12*d* are laser scanning units (LSU) each including a laser irradiation section, a reflecting mirror, etc. However, as the photolithography units 12*a*-12*d*, it is possible to adopt EL or LED write heads each including arrayed light emitting elements. These photolithography units 12*a*-12*d* can form electrostatic latent images in accordance with the inputted image data on the respective photosensitive drums 11*a*-11*d*, by performing exposures of the charged photosensitive drums 11*a*-11*d*.

The developing units 13*a*-13*d* visualize the electrostatic latent images formed on the respective photosensitive drums 11*a*-11*d*, using toner of respective colors (K, C, M, and Y). The photosensitive drums 11*a*-11*d* are provided approximately at the center of the respective image forming sections 4*a*-4*d*. The cleaner units 14*a*-14*d* remove and recover the residual toner on the surfaces of the respective photosensitive drums 11*a*-11*d*, after transferring the images on the sheet.

The transfer feed belt unit 5 is provided below the photosensitive drums 11*a*-11*d*, and includes transfer rollers 15*a*-15*d*, a transfer belt 16, a transfer belt drive roller 17, a transfer belt driven roller 18, a transfer belt tension roller 19, a transfer belt supporting roller 20, and a transfer belt cleaning unit 21. The transfer belt drive roller 17, transfer belt driven roller 18, transfer belt tension roller 19, transfer belt supporting roller 20, and transfer rollers 15*a*-15*d* provide tension to the transfer belt 16 and rotate the same in the direction of an arrow A.

The transfer rollers 15*a*-15*d* are supported by an interior frame (not illustrated) of the transfer belt unit 5 in a rotatable manner, and transfer toner images on the respective photosensitive drums 11*a*-11*d* to a sheet which adsorbs to the transfer belt 16 so as to be carried thereby.

The transfer belt 16 is provided to be in touch with the photosensitive drums 11*a*-11*d*, and has a function to form a multicolor toner image by such an operation that color toner images formed on the respective photosensitive drums 11*a*-11*d* are sequentially laid on and transferred to the sheet. This transfer belt 16 is endless and made of a film around 100 μm thick.

As described above, the transfer of toner images from the photosensitive drums 11*a*-11*d* to the sheet carried by the transfer belt 16 is performed by the transfer rollers 15*a*-15*d* which are in touch with the backside of the transfer belt 16. Thus, to the transfer rollers 15*a*-15*d*, a positive high-voltage whose polarity is opposite to that of the toner is applied. Further, each of the transfer roller 15*a*-15*d* is arranged in such a manner that the surface of a metal shaft such as a stainless shaft is covered with a conductive elastic member such as EPDM and urethane foam. This conductive elastic member allows to uniformly apply a high voltage to the sheet. Note that, instead of the transfer rollers 15*a*-15*d*, it is possible to adopt brush-type transfer electrodes.

To avoid the staining of the backside of the sheet, the toner adhered from the photosensitive drums 11*a*-11*d* to the transfer belt 16 is removed and recovered by the transfer belt cleaning unit 21.

The fixing unit 7 is provided with a heat roller 22 and a pressure roller 23 which pinch the sheet so as to rotate. The control section 3 causes the heat roller 22 to be at a predetermined fixing temperature in compliance with a value detected by a temperature detecting device (not illustrated). Together with the pressure roller 23, the heat roller 22 subjects the sheet to thermo-compression bonding so as to heat-fix multicolor toner images to the sheet, by fusing, mixing, and pressing the multicolor toner images to the sheet.

The registration roller 8 temporarily keeps the sheet fed through the sheet feeding path S. In order to properly multiplex-transfer toner images formed on the respective photosensitive drums 11*a*-11*d*, the registration roller 8 is capable of carrying the sheet with a timing corresponding to the rotations of the respective photosensitive drums 11*a*-11*d*. That is to say, in accordance with an output signal from a before registration detecting switch (not illustrated), the registration roller 8 carries the sheet so as to align the top ends of the respective toner images formed on the photosensitive drums 11*a*-11*d* with the top end of a print range of the sheet.

The sheet feeding path S is a sigmoid feeding path for feeding the sheet in the paper feed tray 6 to the feeder output tray 9 via the transfer feed belt unit 5 and the fixing unit 7.

Around a part of the sheet feeding path S from the paper feed tray 6 to the transfer feed belt unit 5, a pickup roller 24 and the registration roller 8 are provided in this order. The pickup roller 24 is provided at the end portion of the paper feed tray 6, for feeding the sheet from the paper feed tray 6 to the sheet feeding path S on a one-by-one basis.

Around a part of the sheet feeding path S from the feed belt unit 5 to the feeder output tray 9, the fixing unit 7 and feed rollers 25 are provided in this order. The feed rollers 25 are small rollers for facilitating and/or assisting the feeding of the sheet. The feed rollers 25 are provided alongside the sheet feeding path S.

Downstream from the fixing unit 7, a feed direction switching gate 26 for switching the paper output path between a path to the feeder output tray 9 and a path to a feeder output tray 41 provided in a relay feed device 40 (described later). The feed direction switching gate 26 is provided so as to be rotatable with respect to a side cover 27. Switching the feed direction switching gate 26 from the state indicated by a full line to the state indicated by a dotted line as in FIG. 2, the sheet is led to an alternative path from the midstream of the sheet feeding path S, and discharged to the feeder output tray 41. When the feed direction switching gate 26 is in the state indicated by the full line in FIG. 2, the sheet is discharged to the feeder output tray 9 provided upward, via a feeding path S' which is a part of the sheet feeding path S and provided around the fixing unit 7, the side cover 27, and the feed direction switching gate 26.

Next, a paper feed desk device 30 connected to the image forming device 2 will be described below.

As illustrated in FIG. 2, the paper feed desk device 30 includes two paper feed trays (31 and 32) and a duplex tray unit 34 which functions as an aligning device characterizing the present invention. The function of the paper feed trays (31 and 32) is identical with that of the paper feed tray 6 of the image forming device 2, thereby being capable of storing various kinds of sheets in advance. Incidentally, the number of the paper feed trays is not limited to two, and each of the paper feed trays may include a tandem tray in which two trays are provided in parallel, as occasion demands. Further, the paper feed desk device 30 is arranged so that an alternative paper feed tray can be inserted thereto instead of the duplex tray unit 34, when it is unnecessary to perform the duplex image forming function by which images are formed on both sides of a sheet.

A reversing tray 33 is provided in a relay feed device which will be described later, and with regard to a sheet on which an image has been formed, the reversing tray 33 causes the other side of the sheet to face the photosensitive drum 11*a*-11*d* in order to form an image thereon. The sheet is fed to the reversing tray 33 by the relay feed device 40 which will be described later. As to the duplex tray unit 34 which functions as the aligning device, a detailed description will be provided later. When the image forming device 2 is put on the paper feed desk device 30, a space is created between the paper feed desk device 30 and the image forming device 2, by rubber feet t provided on the image forming device 2. To this space, the reversing tray 33 is inserted.

Now, the relay feed device 40 is described in detail.

The relay feed device 40 is a feed device provided on the side of the image forming device 2 and in proximity to a paper output section 28, performing a relay function to feed the sheet discharged from the image forming device 2 to a next device, e.g. the feeder output tray 41 or the paper feed desk device 30. The relay feed device 40 includes a first reversing path 42, a first reversing section 43 provided above the first reversing path 42, and a second reversing section 44 and the reversing tray 33 both provided below the first reversing path 42. The relay feed device 40 is further provided with a first gate 45 and a second gate 46.

The first reversing section 43 performs a switchback function by which the sheet discharged from the image forming device 2 is reversed, with respect to the feeder output tray 41 and additionally provided post-treatment devices (not illustrated). That is to say, the sheet discharged from the paper output section 28 of the image forming device 2 is fully housed in the relay feed device 40, and then the sheet is discharged, reversing its direction so as to head for the feeder output tray 41. The direction is determined by the first gate.

The second reversing section 44 also performs a switchback function similar to that of the first reversing section 43, and hence used for forming images on both sides of a sheet. That is to say, when images are formed on both sides of a sheet, the sheet is discharged from the paper output section 28 of the image forming device 2 and fed to the second reversing section 44 via the first reversing section 43. Then the sheet is temporarily housed in the reversing tray 33 which is provided between the paper feed desk device 30 and image forming device 2 and performs as a second reversing path, and subsequently the sheet is discharged from the second reversing section 44 and passes through a feeding path 47 which is different from the path through which the sheet entered the reversing tray 33. Consequently, the sheet is housed in the duplex tray unit 34 in the paper feed desk device 30. The selection of the feeding path 47 is performed by the second gate.

Note that, a path for feeding a sheet, from the first reversing path 42 to the registration roller 8 via the reversing tray 33 which is the second reversing path, the feeding path 47, and the duplex tray unit 34, is called a re-feeding path.

Now, the following will describe the duplex tray unit 34 performing as an aligning device characterizing the present invention, with reference to FIGS. 1 and 3-6. In the following description, the duplex tray unit 34 is regarded as an aligning device.

Figure 3:
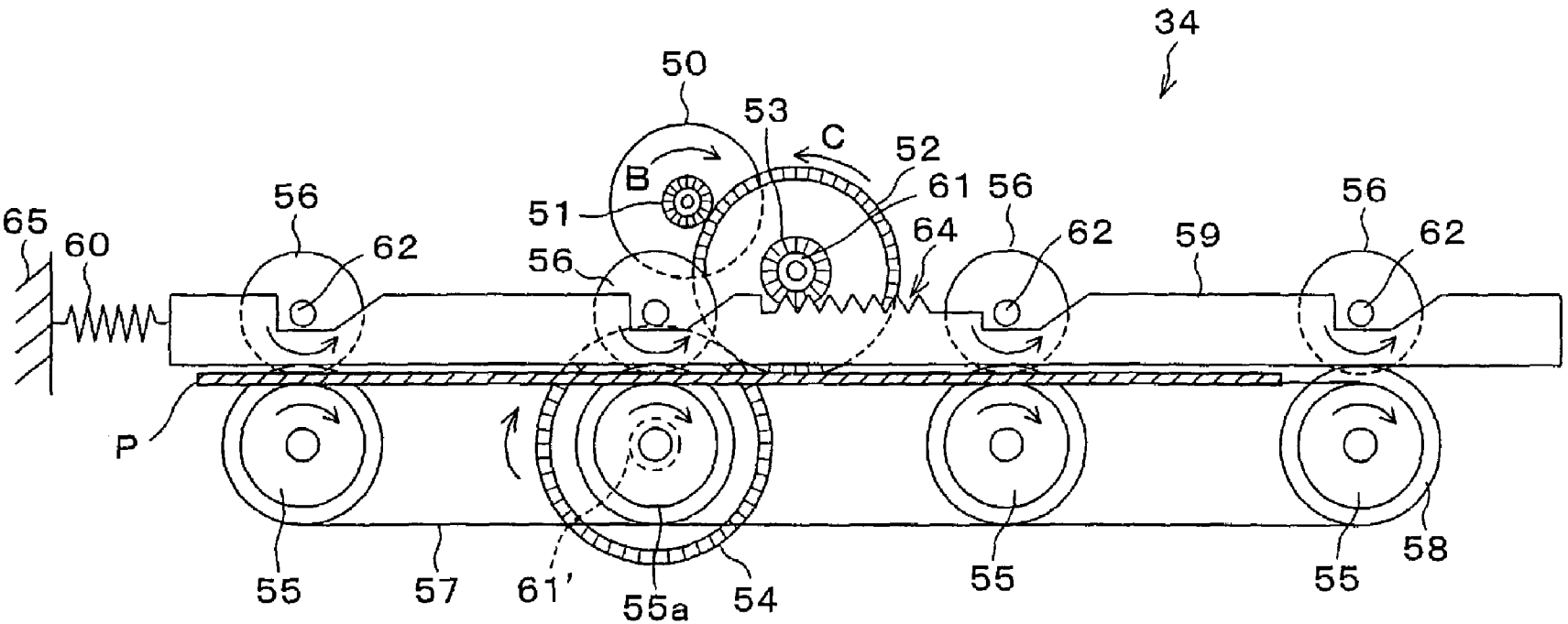
FIG. 3 is another cross section of the aligning device.

FIG. 3 is a cross section of the aligning device before or after performing the alignment of a sheet. The aligning device is, as illustrated in FIG. 3, provided with a motor (drive source) 50, a first gear 51, a second gear 52, a third gear 53 (power transmission means), a fourth gear 54, feed rollers 55, driven rollers 56, a feed belt 57, a pulley 58, a slide arm (cam means) 59, a spring (elastic member) 60, a one-way clutch (first one-way clutch) 61, driven roller rotating shafts 62, and driven roller rotating shaft block up boards 63 (cf. FIG. 4). Components other than them will be described later, with reference to corresponding figures. Note that, the fourth gear 54, the feed rollers 55, the driven rollers 56, and the feed belt 57 are collectively termed feed means, and the third gear 53 and the slide arm 59 are collectively termed release means.

The motor 50 can rotate both in the direction of an arrow B (clockwise direction) in FIG. 3 and in the opposite direction (anticlockwise direction). The rotating shaft of the motor 50 is provided with the first gear 51, and this first gear 51 is engaged with the second gear 52. The second gear 52 changes its rotative direction, as the rotative direction of the first gear 51 is changed.

The third gear 53 shares the shaft with the second gear 52, and is engaged with a rack section 64 of the slide arm 59. Between the third gear 53 and the shaft, the one-way clutch 61 is provided. For this reason, when the motor 50 rotates in the direction of the arrow B (clockwise direction), the third gear 53 slips on the shaft so as not to rotate. In other words, the third gear 53 rotates in the direction identical with the rotation of the second gear 52 (i.e. in the clockwise direction) in accordance with the rotation of the shaft, only when the motor 50 rotates in the anticlockwise direction.

The second gear 52 is also engaged with the fourth gear 54 sharing the rotating shaft with a roller 55*a* which is one of the feed rollers 55. Thus, as the motor 50 rotates, the second gear 52 also rotates so that eventually the fourth gear 54 rotates in accordance with the second gear 52. The roller 55*a* and the fourth gear 54 rotate in an interlocking manner. Further, the roller 55*a* drives other feed rollers 55, with the help of the feed belt 57. Moreover, driven rollers 56 are provided so as to oppose the respective feed roller 55. These driven rollers 56 rotate in the direction opposite to the rotation of the feed rollers 55, i.e. the drive rollers 56 are driven by the feed rollers 55.

Figure 4:
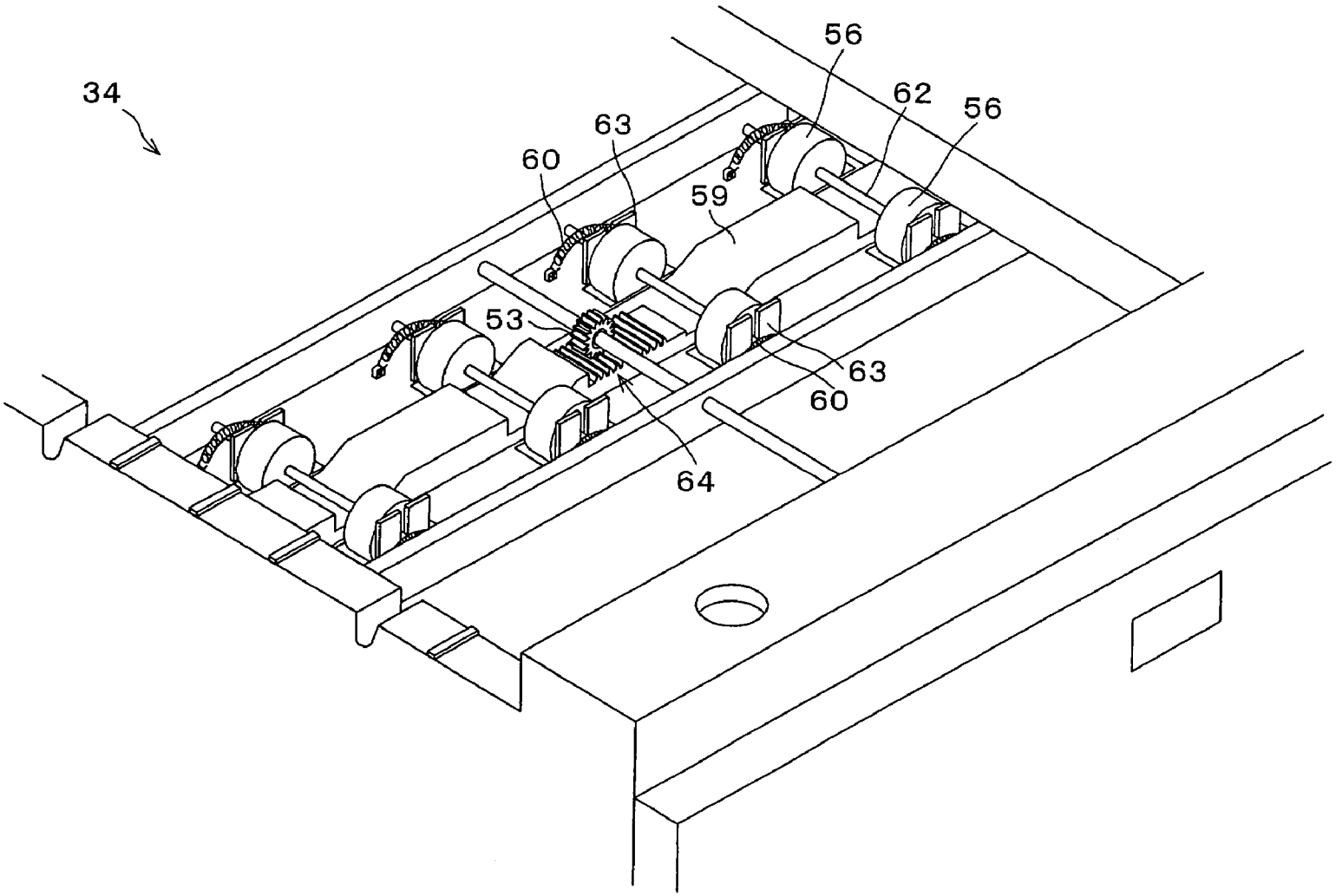
FIG. 4 is an oblique perspective view of the aligning device.

FIG. 4 is an oblique perspective view of a part of the aligning device. Driven roller rotating shafts 62 of the respective drive rollers 56 are, as illustrated in FIG. 4, arranged not to move towards the direction of sheet feeding, by the respective driven roller rotating shaft block up boards 63. Meanwhile, the driven roller rotating shafts 62 can move in the direction orthogonal to the sheet feeding. Some of the driven roller rotating shafts 62 are provided on the slide arm 59. To keep the pinching forces for feeding a sheet exerted by the driven rollers 56 and the feed rollers 55, both ends of each driven roller rotating shaft 62 are supported by the springs 64 in the direction towards the feed rollers 55.

On the top of the slide arm 59, i.e. on the side not facing the feed rollers 55, respective notches which are provided for mounting the driven roller rotating shafts 62 and each shaped partially like a slope are formed, as illustrated in FIGS. 3 and 4. The number of the notches is identical with the number of the driven roller rotating shaft 62. For feeding a sheet, the driven rollers 56 are provided so as not to be in touch with the bottoms of the respective notches, each of the bottoms being flat and connected to the lower end of the slope. Further, the spring 60 is provided between a spring fixing wall 65 and the end face of the slide arm 59, the end face being on the side from which a sheet is fed. When feeding a sheet, the length of the spring 60, the position of the slide arm 59, and the position of the spring fixing wall 65 are adjusted in order to prevent the slide arm 59 from being influenced by the force of the spring 60.

Figure 1:
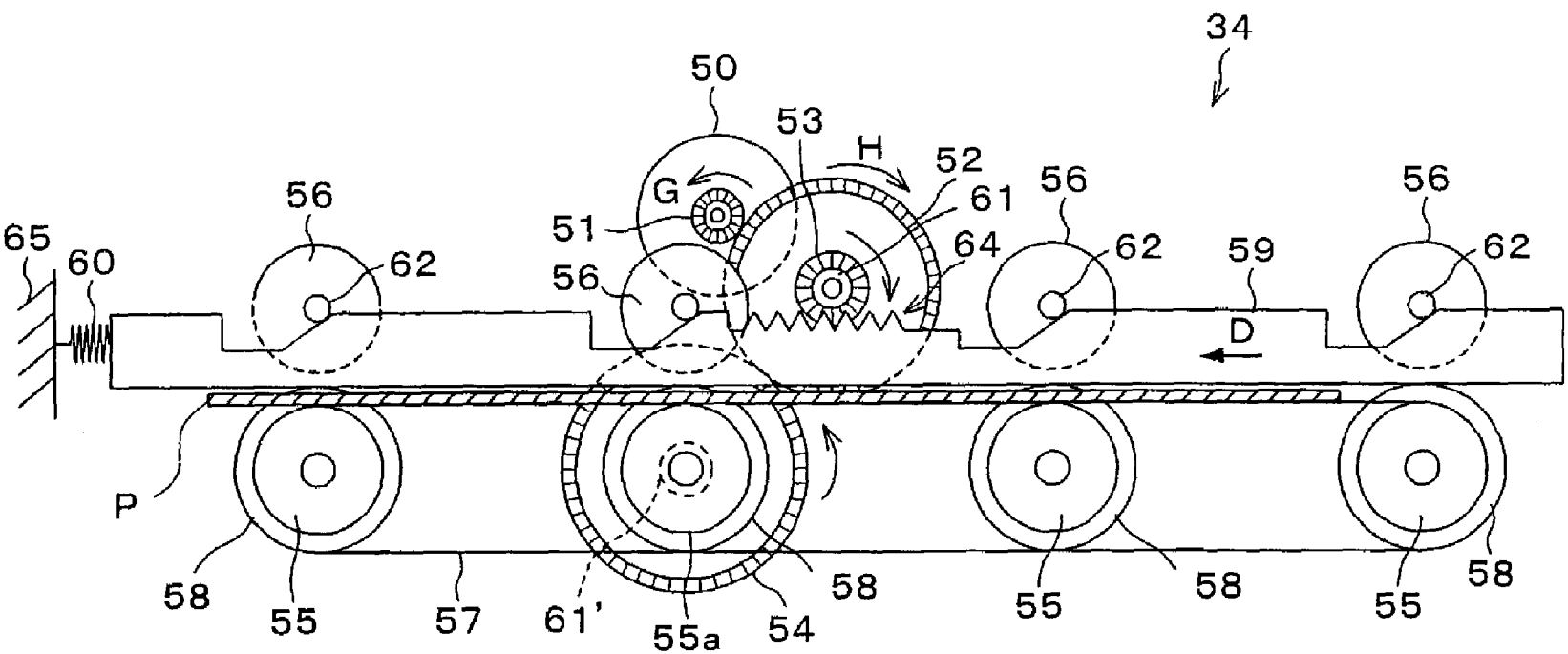
FIG. 1 is a cross section illustrating an embodiment of an aligning device in accordance with the present invention.
Figure 5:
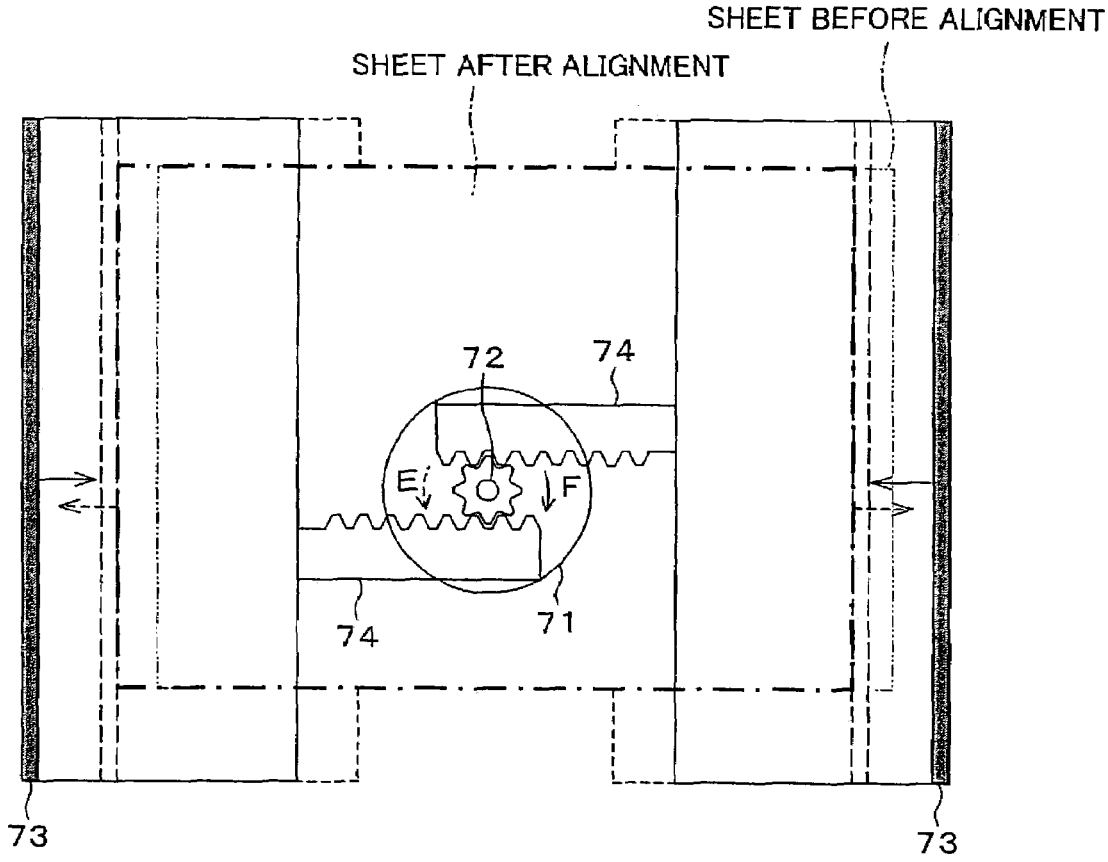
FIG. 5 is a plan view of an aligning section of the aligning device.

Next, referring to FIGS. 1 and 5, the following will describe the operations of releasing the pinching forces exerted by the feed rollers 55 and driven roller 56 to the sheet being fed, and performing alignment of the sheet.

First of all, as FIG. 1 illustrates, the motor 50 rotates in the direction of an arrow G in the figure (anticlockwise direction). This causes the first gear 51 to rotate in the anticlockwise direction, and the second gear 52 engaged with the first gear 51 rotates in the direction of an arrow H (anticlockwise direction). As the second gear 52 rotates, the third gear 53 rotates in the direction identical with the second gear 52 (i.e. in the clockwise direction).

Since the third gear 53 rotates in the clockwise direction, the slide arm 59 is caused to move in the direction to compress the spring 60, i.e. in the direction of an arrow D in FIG. 1, by means of the rack section 64. Owing to the movement of the slide arm 59 in this direction, the driven roller rotating shafts 62 are caused to move upward, i.e. in the direction away from the feed rollers 55, and eventually contact the corresponding slopes of the respective notches of the slide arm 59. In this state, it is possible to release the pinching forces exerted to the sheet by the feed rollers 55 and the driven rollers 56. In this state, moreover, the spring 60 is compressed and hence pushes the slide arm 59 towards the direction opposite to the spring fixing wall 65. Thus, the motor 50 produces torque (holding torque) for opposing the pushing force of the spring 60, in order to keep the position of the slide arm 59.

When releasing the pinching forces as above, the rotation of the second gear 52 causes the fourth gear 54 to rotate in the anticlockwise direction. This rotation of the fourth gear 54 causes the roller 55*a* to rotate so that the sheet is caused to move back for a certain distance in the direction opposite to the feeding of a sheet.

To prevent the sheet from moving back, a second one-way clutch 61' is provided between the fourth gear 54 and the shaft supporting the fourth gear 54. That is to say, the second one-way clutch 61' is provided so that the roller 55*a* cannot rotate when the fourth gear 54 rotates in the anticlockwise direction, while the roller 55*a* rotates in the clockwise direction when the fourth gear 54 rotates in the clockwise direction. Also, the shaft is further provided with the pulley 58, and hence the remaining feed rollers 55 can operate in a similar manner with the feed roller 55*a*, via the belt 57.

As described above, thanks to the second one-way clutch 61', it is possible to prevent the feed roller 55*a* from rotating in the anticlockwise direction, i.e. in the direction opposite to sheet feeding, and thus the sheet alignment operation can be performed in a more stable manner.

Note that, in the aligning device of the present embodiment, it is not always necessary to provide the second one-way clutch 61'. This is because the moving back of the sheet is not so serious, and as in the foregoing descriptions, the sheet feeding operation is controlled in accordance with an output signal from the before registration detecting switch so that the top ends of respective toner images formed on the photosensitive drums 11*a*-11D are aligned with the top end of a print range of a sheet.

Next, while keeping the pinching forces to the sheet to be released as above, the sheet alignment is performed. The following will describe the operation of aligning the sheet, with reference to FIG. 5.

FIG. 5 is a plan view of an aligning section 70 of the foregoing aligning device, illustrating the conditions before or after the alignment of a sheet. Note that, the aligning device is provided for eliminating the misalignment in the direction orthogonal to the direction of sheet feeding. Also, in FIGS. 1 and 3, the aligning section 70 is not illustrated for the sake of simplicity.

Apart from the above-mentioned components, the aligning device includes a jogger motor 71, a gear 72, joggers 73, and racks 74. The gear 72 is fixed to the rotating shaft of the jogger motor 71. The joggers 73 are provided at the both ends of the aligning device, for correcting the misalignment of a sheet by directly contacting the edges of the sheet. The joggers 73 move corresponding to the operations of the respective racks 74. Further, the gear 71 is engaged with the racks 74.

The jogger motor 71 rotates in the direction of an arrow E in FIG. 5 so that the gear 72 rotates in the same direction. The rotation of the gear 72 causes the joggers 73 to come close to each other, by means of the racks 74. The moving distance of each of the joggers 73 is proportional to the rotation of the jogger motor 71. Thus, it is possible to correct the misalignment of the sheet in the direction orthogonal to the direction of sheet feeding, by means of the movement of the joggers 73.

After the correction of the sheet misalignment, the feed rollers 55 and the driven rollers 56 pinch the sheet again. In other words, the sheet returns to the condition for being fed in a proper fashion, as illustrated in FIG. 3. The following will describe this operation to cause the sheet to be in the condition for sheet feeding again.

When the correction of the sheet misalignment by the joggers 73 is finished, the slide arm 59 is, as illustrated in FIG. 3, in the position close to the spring fixing wall 65. On this account, the spring 60 is compressed as described above and hence pushes the slide arm 59 in the direction away from the spring fixing wall 65. On this occasion, the torque produced by the motor 50 for opposing the force of pushing back, the force exerted by the spring 60 (hereinafter, this force will be referred to as pushing force), is eliminated. In other words, the motor 50 is caused not to produce the torque (holding torque). This arrangement allows the third gear 53 having been interlocked with the second gear 52 to freely rotate.

Thus, thanks to the pushing force by the spring 60, the slide arm 59 moves back to the position for sheet feeding. On this account, as illustrated in FIG. 3, the driven rollers 56 move downward, i.e. nearer to the feed rollers 55, and hence the sheet is pinched by the feed rollers 55 and the driven rollers 56. Then the sheet having been pinched is carried on the feed belt 57.

In order to return the joggers 73 to the original position, i.e. the position before the alignment, the jogger motor 71 is caused to rotate in the direction opposite to the case of the correction of misalignment, i.e. in the direction of an arrow F in FIG. 5, before the feeding of a next sheet to the aligning device.

Next, a method of controlling the image forming system 1 will be described below.

Figure 6:
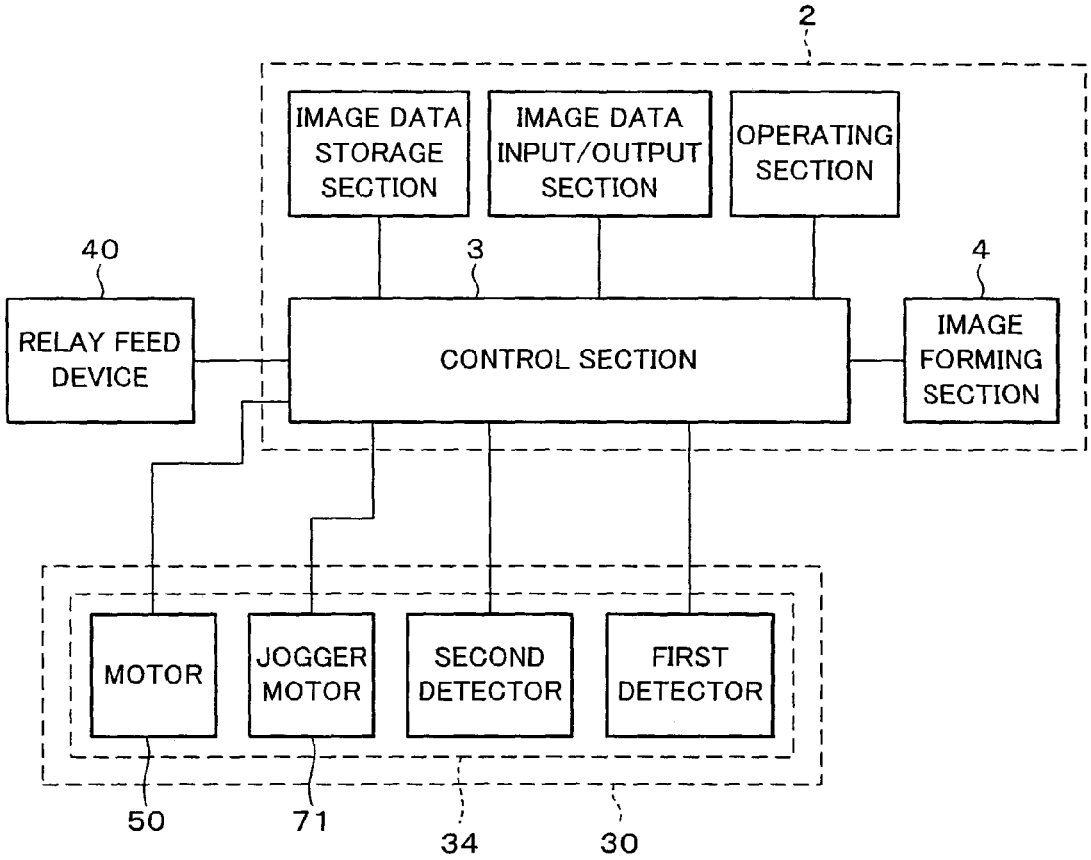
FIG. 6 is a block diagram illustrating the control of the aligning device.

FIG. 6 is a block diagram illustrating the control of the image forming system 1. An image forming order is transmitted from an operating section in the image forming device 2 to an image data input/output section via the control section 3, and hence the input of the image data is performed. Then the image data is supplied to an image data storage section via the control section 3 so as to be stored in the image data storage section, and subsequently an image is formed in accordance with the image data, in the image forming section 4.

On this occasion, the control section 3 is connected to the paper feed desk device 30 and the relay feed device 40, thereby performing the alignment and sheet feeding in accordance with the order from the operating section. That is to say, following the order transmitted via the control section 3, the operations of the components of the relay feed device 40 and the operations of members such as the motor 50 in the aligning device, the jogger motor 71, and first and second detectors for detecting a sheet are performed. When the sheet alignment operation is finished in the duplex tray unit 34 which is the aligning device, the order indicating the finish is transmitted to the control section 3 so that a next image processing step starts.

As described above, the aligning device in accordance with the present embodiment is arranged such that the fourth gear 54, the feed rollers 55, the driven rollers 56, and the feed belt 57 which are the feed means, and the third gear 53 and the slide arm 59 which are the release means, are operated by the motor 50 which is a single drive source.

Thus, it is possible to cause the feed means and the release means to share a single drive source, and this allows to downsize the aligning device and reduce the manufacturing costs. Further. the sharing of a single drive source allows to reduce the numbers of control signal lines and power supply lines for controlling the feed means and the release means. Moreover, it is unnecessary to control a plurality of drive sources and hence the control is simplified. For these reasons, it is possible to provide an aligning device which is low-cost and has a simple arrangement.

Note that, although in the foregoing descriptions the aligning device is provided in the paper feed desk device 30, the present embodiment is not limited to this arrangement so that, for instance, the aligning device is provided being independent of the paper feed desk device 30.

It will be appreciated that the present invention is not to be limited by the above-mentioned embodiment, and hence numerous modifications are possible within the scope of the present invention. For instance, although in the embodiment above the motor 50 is fixed to a predetermined position and the second gear 52 is engaged with the fourth gear 54, the present invention is not to be limited by this arrangement, and thus, there is such a possible arrangement that the motor is movable and the second gear 52 is not engaged with the fourth gear 54.

That is to say, there is such an arrangement that the motor 50 moves to a predetermined position (first position) so that the first gear 51 is engaged with the second gear, and the motor 50 moves to a second position which is different from the first position so that the first gear is engaged with the fourth gear. The direction of the movement of the motor 50 is not particularly limited, and hence the motor 50 may move in the direction parallel to the rotating shaft thereof or in the direction perpendicular to the rotating shaft.

As described above, the aligning device of the present invention is arranged so as to include: feed means for feeding a sheet on which an image is formed; and release means for releasing a pinching force exerted to the sheet by the feed means, a position of the sheet being aligned in a sheet-width direction orthogonal to a direction of sheet feeding, by releasing the pinching force by the release means, wherein, the feed means and the release means are driven by a single drive source.

Further, the above-mentioned aligning device of the present invention is arranged such that, the drive source is a motor, and switchover between a feed mode for feeding the sheet by the feed means and a release mode for releasing the pinching force exerted to the sheet is performed by changing a rotative direction of the motor.

According to this arrangement, the motor is adopted as the drive source of the aligning device, and by changing the rotative direction of this motor, it is possible to determine whether the sheet feeding is performed or the pinching force exerted to the sheet is released.

Thus, without providing a drive source such as a solenoid, the aligning device with a simple structure, which can easily perform the sheet feeding and the release of the pinching force exerted to the sheet, is obtained.

Further, the above-mentioned aligning device of the present invention is arranged such that, the feed means includes feed rollers and driven rollers which are driven by the feed rollers, the feed rollers and the driven rollers being provided for pinching the sheet, the release means includes cam means which allows the driven rollers to get away from the feed rollers, and the rotative direction of the motor is switched from a direction for the feed mode to a direction for the release mode so that the cam means causes the driven rollers to get away from the feed rollers, while the rotative direction of the motor is switched from the direction for the release mode to the direction for the feed mode so that the cam means causes the driven rollers to come close to the feed rollers.

According to this arrangement, the rotative direction of the motor is changed from the direction for the feed mode to the direction for the release mode so that the cam means causes the driven rollers to move in the direction for releasing the pinching force exerted to the sheet. Also, the rotative direction of the motor is changed from the direction for the release mode to the direction for the feed mode so that the cam means causes the drive rollers to move in the direction for exerting the pinching force to the sheet. In short, the pinching force is exerted to the sheet when switched to the feed mode.

Thus, controlling the rotative direction of the motor allows either the driven rollers to get away from the feed rollers so that the pinching force is released, or the driven rollers to come close to the feed rollers so that the sheet having been pinched is carried.

Further, the foregoing aligning device in accordance with the present invention is arranged such that, the feed means includes feed rollers and driven rollers which are driven by the feed rollers, the feed rollers and the driven rollers being provided for pinching the sheet, the release means includes cam means which allows the driven rollers to get away from the feed rollers, and power transmission means which is engaged with the cam means and hence causes the cam means to move, the cam means is connected to an end of an elastic member, the other end of the elastic member being fixed, the power transmission means is combined with the motor via a first one-way clutch, and the rotative direction of the motor is switched from a direction for the feed mode to a direction for the release mode so that the cam means causes the driven rollers to get away from the feed rollers, while the rotative direction of the motor is switched from the direction for the release mode to the direction for the feed mode so that, by means of the elastic member, the cam means causes the driven rollers to come close to the feed rollers.

According to this arrangement, the rotative direction of the motor is changed from the direction for the feed mode to the direction for the release mode so that the cam means causes the driven rollers to move in the direction for releasing the pinching force exerted to the sheet. Also, the rotative direction of the motor is changed from the direction for the release mode to the direction for the feed mode so that, due to the elastic force of the elastic member, the cam means causes the drive rollers to move in the direction for exerting the pinching force to the sheet. In short, the pinching force is exerted to the sheet when switched to the feed mode.

Thus, controlling the rotative direction of the motor allows either the driven rollers to get away from the feed rollers so that the pinching force is released, or the driven rollers to come close to the feed rollers so that the sheet having been pinched is carried. Further, the one-way clutch allows the following arrangement: the direction of power transfer by the one-way clutch is selected so that the power transfer from the motor to the power transmission means engaged with the cam means is stopped, on the occasion of rotating the motor in the feed mode.

Further, the foregoing aligning device in accordance with the present invention is arranged such that, the feed rollers are combined with the motor via a second one-way clutch.

According to this arrangement, thanks to the second one-way clutch, only the driving force produced by the rotation of the motor in one particular direction is transmitted to the feed rollers.

Thus, by selecting the direction of the power transfer by the second one-way clutch, it is possible to prevent the feed rollers from rotating in the direction opposite to the direction of sheet feeding, on the occasion of the release mode. In other words, the feed rollers can rotate in the direction of sheet feeding, only on the occasion of the feed mode. Thus, it is possible to prevent the sheet from being carried in the direction opposite to the direction of sheet feeding, and hence the sheet alignment operation is stably performed.

Further, the image forming system in accordance with the present invention is arranged so as to include the above-mentioned aligning device of the present invention.

Further, the above-mentioned image forming system of the present invention further comprises a re-feeding path for feeding the sheet again to an image forming section for forming an image, in order to form images on both sides of the sheet, the re-feeding path being provided with the aligning device.

According to this arrangement, the re-feeding path before re-feeding the sheet to the image forming section is provided with the aligning device.

Thus, the sheet alignment operation can be performed prior to the formation of an image on the surface of the sheet opposite to the surface on which an image has been formed. On this account, respective image forming positions on both sides of the sheet are properly aligned in the sheet-width direction orthogonal to the direction of sheet feeding, and thus it is possible to perform high-quality image formation.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An aligning device, comprising:

feed means comprised of plural pairs of feeding elements for feeding a sheet on which an image is formed;

release means for releasing a pinching force exerted to the sheet by the plural pairs of feeding elements; and alignment means for, when the pinching force is released by the release means, aligning a position of the sheet in a sheet-width direction orthogonal to a direction of sheet feeding, wherein the feed means and the release means are driven by a single drive source, wherein, the drive source is a motor, and switchover between a feed mode for feeding the sheet by the feed means and a release mode for releasing the pinching force exerted to the sheet is performed by changing a rotative direction of the motor, wherein, the feed means includes feed rollers and driven rollers which are driven by the feed rollers, the feed rollers and the driven rollers being provided for pinching the sheet, the release means includes cam means for moving the driven rollers away from the feed rollers, and power transmission means which is engaged with the cam means and hence causes the cam means to move, the cam means is connected to an end of an elastic member, the other end of the elastic member being fixed, the power transmission means is combined with the motor via a first one-way clutch, and the rotative direction of the motor is switched from a direction for the feed mode to a direction for the release mode so that the cam means causes the driven rollers to get away from the feed rollers, while the rotative direction of the motor is switched from the direction for the release mode to the direction for the feed mode so that, under action of the elastic member, the cam means causes the driven rollers to come close to the feed rollers.

2. The aligning device as defined in claim 1, wherein, the feed rollers are combined with the motor via a second one-way clutch.

3. The aligning device as set forth in claim 1, wherein the release means releases the pinching force exerted by the plural pairs of feeding elements at the same time.

4. An aligning device, comprising:

feed means comprised of plural pairs of feeding elements for feeding a sheet on which an image is formed;

release means for releasing a pinching force exerted to the sheet by the plural pairs of feeding elements; and alignment means for, when the pinching force is released by the release means, aligning a position of the sheet in a sheet-width direction orthogonal to a direction of sheet feeding, wherein the feed means and the release means are driven by a single drive source, wherein, the drive source is a motor, and switchover between a feed mode for feeding the sheet by the feed means and a release mode for releasing the pinching force exerted to the sheet is performed by changing a rotative direction of the motor, wherein, the feed means includes feed rollers and driven rollers which are driven by the feed rollers, the feed rollers and the driven rollers being provided for pinching the sheet, the release means includes cam means for moving the driven rollers away from the feed rollers, and the rotative direction of the motor is switched from a direction for the feed mode to a direction for the release mode so that the cam means causes the driven rollers to get away from the feed rollers, while the rotative direction of the motor is switched from the direction for the release mode to the direction for the feed mode so that the cam means causes the driven rollers to come close to the feed rollers, wherein, the feed rollers are combined with the motor via a second one-way clutch.

5. The aligning device of claim 4, wherein the second one-way clutch prevents a feed roller from rotating in a direction opposite to the sheet feeding direction.

6. The aligning device of claim 4, wherein the release means further includes power transmission means which is combined with the motor via a first one-way clutch and is engaged with the cam means and hence causes the cam means to move.

7. The aligning device of claim 4, wherein the cam means comprises a single cam member, which causes movement of all of the driven rollers.

8. An image forming system comprising an aligning device, the aligning device including:

feed means comprised of plural pairs of feeding elements for feeding a sheet on which an image is formed;

release means for releasing a pinching force exerted on the sheet by the plural pairs of feeding elements; and alignment means for, when the pinching force is released by the release means, aligning a position of the sheet in a sheet-width direction orthogonal to a direction of sheet feeding, wherein the plural pairs of feeding elements and the release means are driven by a single drive source, wherein, the drive source is a motor, and switchover between a feed mode for feeding the sheet by the feed means and a release mode for releasing the pinching force exerted to the sheet is performed by changing a rotative direction of the motor, wherein, the feed means includes feed rollers and driven rollers which are driven by the feed rollers, the feed rollers and the driven rollers being provided for pinching the sheet, the release means includes cam means for moving the driven rollers away from the feed rollers, and power transmission means which is engaged with the cam means and hence causes the cam means to move, the cam means is connected to an end of an elastic member, the other end of the elastic member being fixed, the power transmission means is combined with the motor via a first one-way clutch, and the rotative direction of the motor is switched from a direction for the feed mode to a direction for the release mode so that the cam means causes the driven rollers to get away from the feed rollers, while the rotative direction of the motor is switched from the direction for the release mode to the direction for the feed mode so that, under action of the elastic member, the cam means causes the driven rollers to come close to the feed rollers.

9. The image forming system as defined in claim 8, further comprising a re-feeding path for feeding the sheet again to an image forming section for forming an image, in order to form images on both sides of the sheet, the re-feeding path being provided with the aligning device.

* * * * *